US008304995B2

(12) United States Patent
Ku et al.

(10) Patent No.: US 8,304,995 B2
(45) Date of Patent: Nov. 6, 2012

(54) LAMP WITH SNOW REMOVING STRUCTURE

(75) Inventors: Chin-Long Ku, Taipei Hsien (TW); Chin-Wen Yeh, Taipei Hsien (TW); Zhen-Neng Lin, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 310 days.

(21) Appl. No.: 12/770,752

(22) Filed: Apr. 30, 2010

(65) Prior Publication Data

US 2011/0101864 A1 May 5, 2011

(30) Foreign Application Priority Data

Oct. 29, 2009 (CN) ..... 2009 1 0309040

(51) Int. Cl.
*H01J 13/32* (2006.01)

(52) U.S. Cl. ..... 315/115; 315/116

(58) Field of Classification Search ..... 315/115, 315/116

See application file for complete search history.

(56) References Cited

U.S. PATENT DOCUMENTS 3,868,620 A * 2/1975 McBride et al. ..... 338/28
5,834,908 A * 11/1998 Boland et al. ..... 315/307
2006/0011598 A1* 1/2006 Yasuda ..... 219/205

FOREIGN PATENT DOCUMENTS

JP 2001-298314 * 10/2001

* cited by examiner

*Primary Examiner* — Wai Sing Louie
(74) *Attorney, Agent, or Firm* — Altis Law Group, Inc.

(57) ABSTRACT

A lamp includes a bracket having a cover, a lamp body fixed to the bracket by a shaft, a heating device and a pressure switch. The lamp body includes first and second portions at opposite sides of the shaft. The heating device is mounted at the first portion of the lamp body and the cover. The pressure switch is mounted to the cover and engages with a top of the second portion. When a weight of the snow/ice accumulated on the first portion of the lamp body is beyond a set value, the pressure switch controls the heating device to be switched on to melt the snow/ice; when the weight of the snow/ice accumulated on the lamp body decreases to be less than the set value, the pressure switch controls the heating device to be switched off.

9 Claims, 5 Drawing Sheets

LAMP WITH SNOW REMOVING STRUCTURE

BACKGROUND

1. Technical Field

The present disclosure relates to a lamp and, more particularly, to a lamp with snow removing structure, whereby snow on a top of the lamp can automatically be removed when the snow is accumulated to a certain amount.

2. Description of Related Art

An outdoor lamp such as a street lamp is widely installed throughout the country due to road safety and security purpose. Conventionally, the street lamp includes a lamp post and a lamp body fastened at a top of the lamp post. A light source with high luminance irradiation is installed in a bottom of the lamp body and provides light to the ground. However, since the lamp body is exposed to ambient air, the lamp body is often covered with snow or ice in snow/snowstorm day. The snow or ice accumulated on the lamp body, if too much, possibly causes a heavy load on the lamp body which may result in a damage to the lamp body or even a break of the lamp body from the lamp post.

What is needed, therefore, is a lamp with snow removing structure to remove snow or ice thereon when the snow or ice accumulated thereon reaches a predetermined amount.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
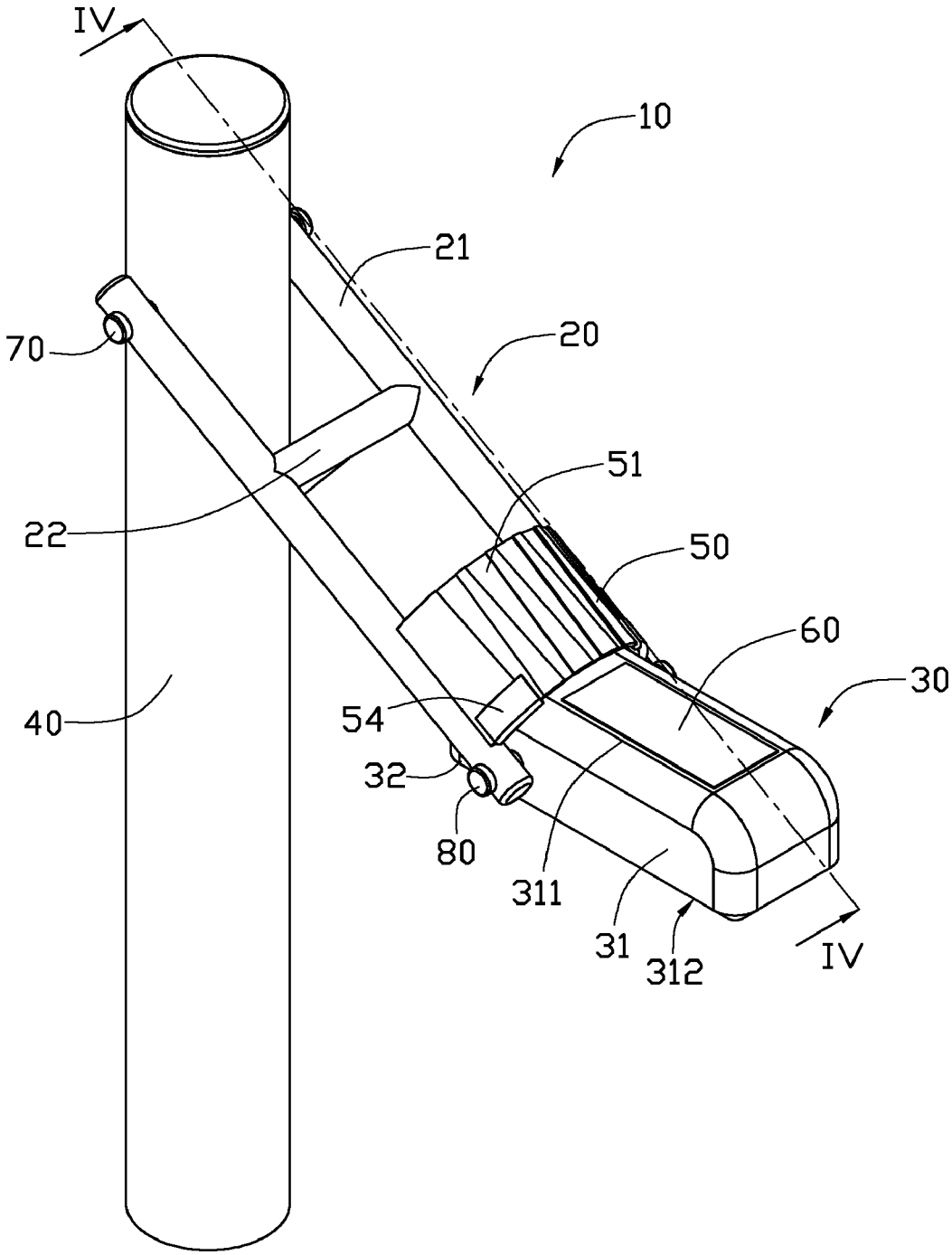
FIG. 1 is an assembled view of a lamp in accordance with a first embodiment of the present disclosure.
Figure 2:
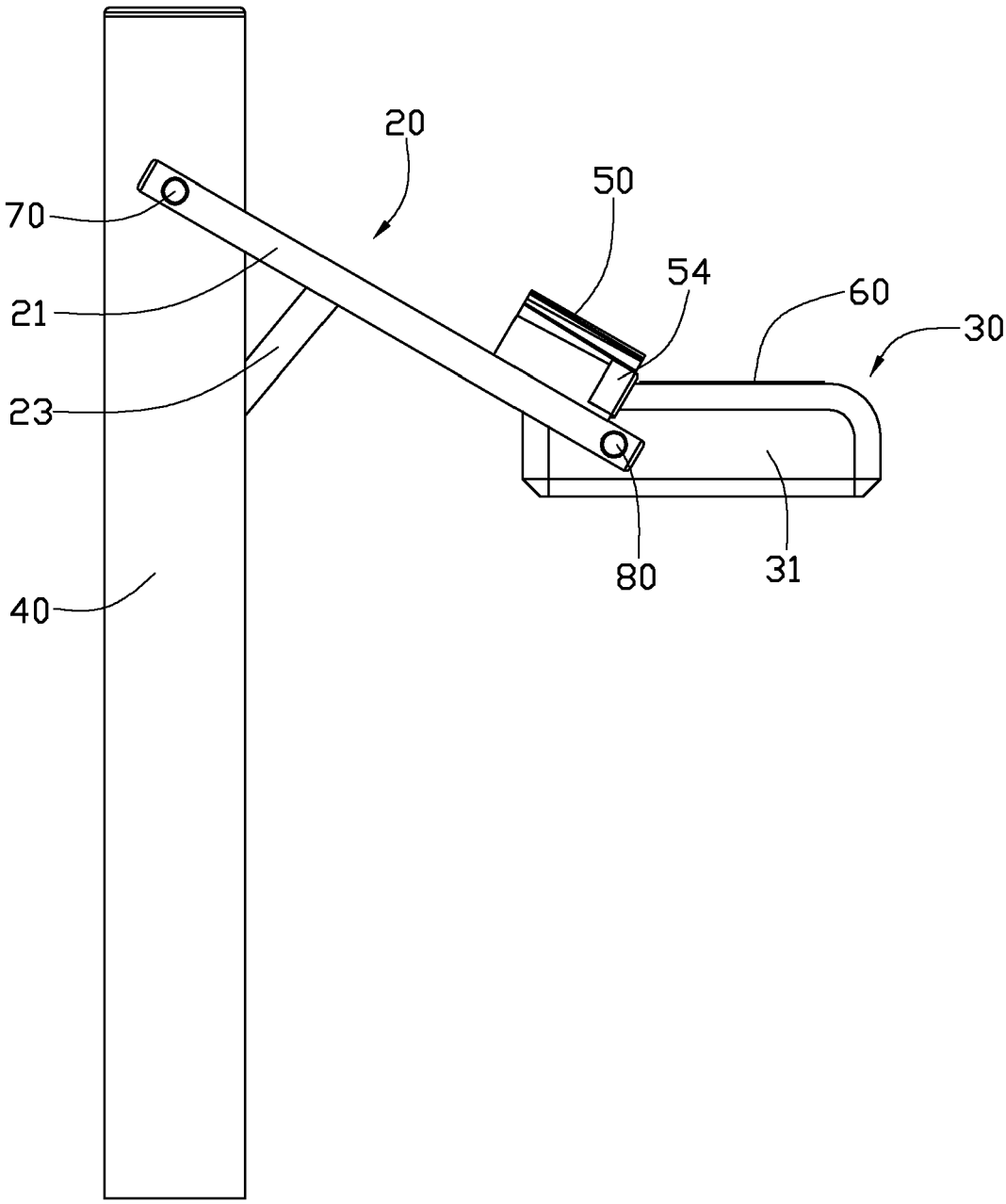
FIG. 2 is a side view of the lamp of FIG. 1.
Figure 3:
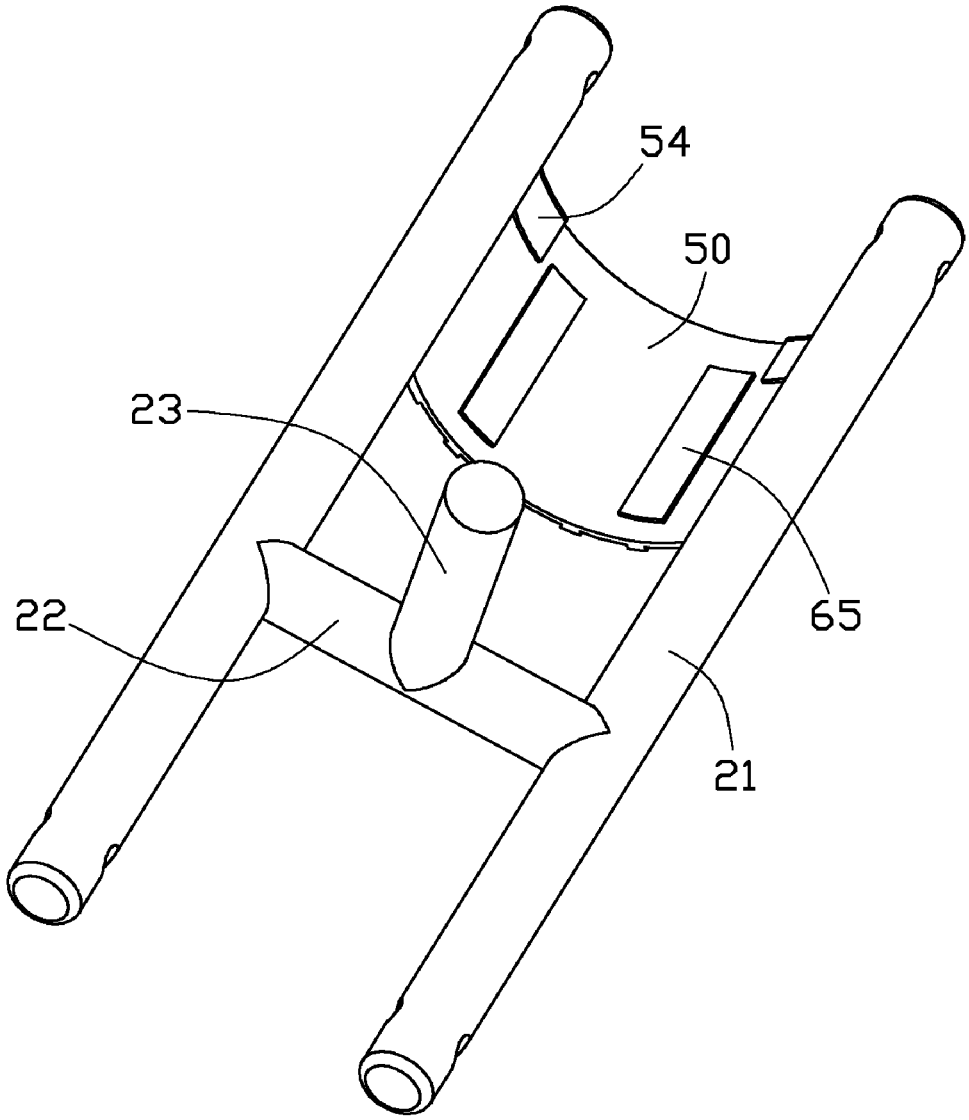
FIG. 3 is an assembled view of a bracket and a cover of the lamp of FIG. 1.
Figure 4:
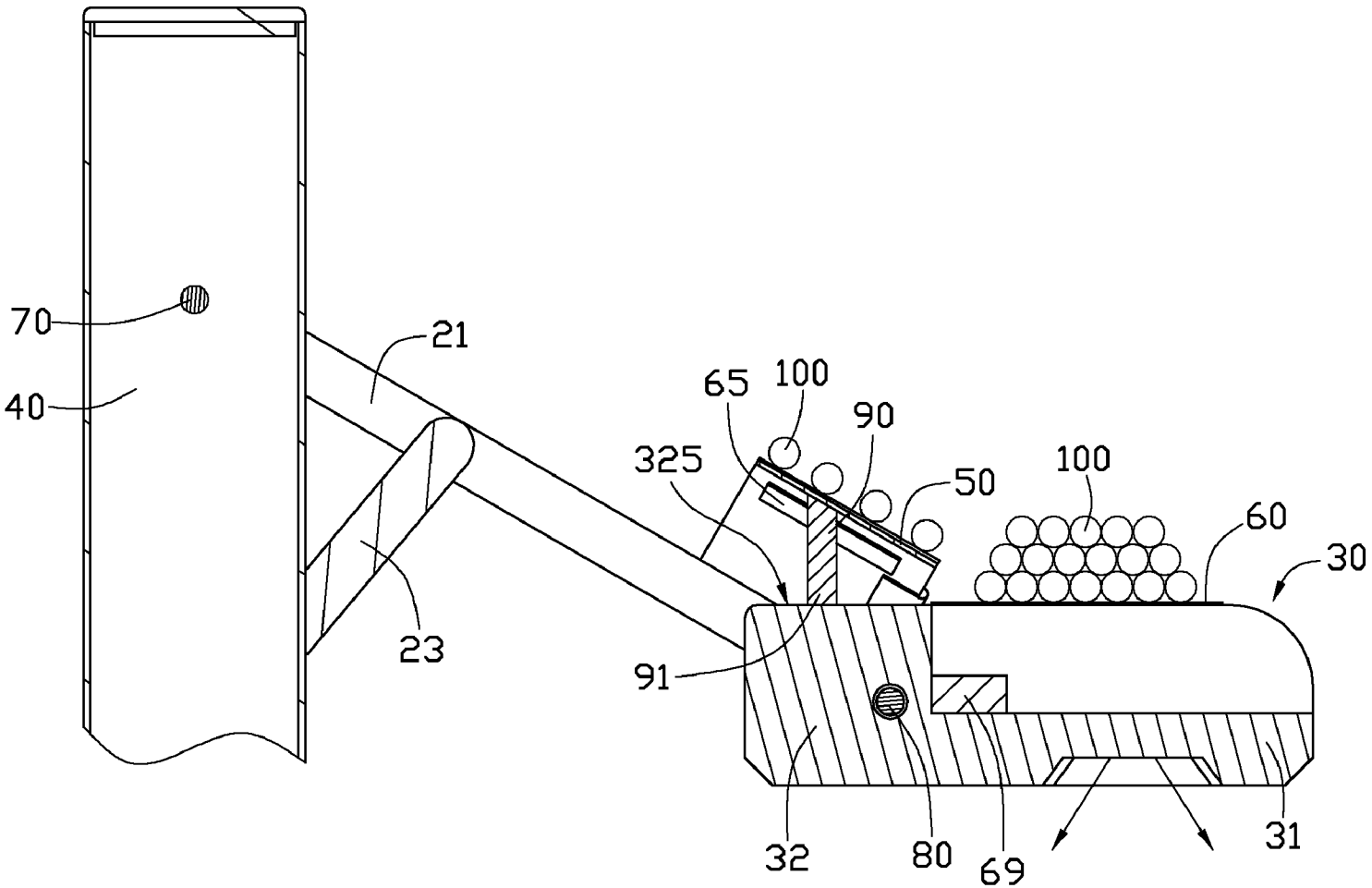
FIG. 4 is a cross-sectional view of the lamp of FIG. 1, taken along line IV-IV thereof, with snow/ice accumulated on a top of a lamp body thereof.

Referring to FIGS. 1-4, a lamp 10 in accordance with a first embodiment of the disclosure is illustrated. The lamp 10 is an outdoor lamp such as a street lamp, a landscape lamp, and so on. The lamp 10 comprises a luminous device, a heating device, and a sensor switch module controlling on or off of the heating device. In the first embodiment, the luminous device is a lamp body 30. The heating device comprises a first heating member 60 and two second heating members 65. The sensor switch module is a pressure switch 90 in the first embodiment. The lamp 10 further comprises an inclined bracket 20 and a lamp post 40 to engage a top end of the bracket 20. The lamp body 30 is pivotably engaged with a bottom end of the bracket 20. Alternatively, the lamp post 40 can be omitted, and the bracket 20 may be installed onto a wall. The bracket 20 includes a cover 50 located above a top of a lateral portion of the lamp body 30.

The top end of the bracket 20 is firmly fixed to the lamp post 40 via a fastener 70, and the bottom end thereof is pivotably connected with the lamp body 30 via a shaft 80. The bracket 20 includes two main beams 21, a middle beam 22 and a supporting beam 23. The main beams 21 extend slantways from the lamp post 40. The middle beam 22 perpendicularly interconnects middle portions of the main beams 21, whereby the middle beam 22 and the main beams 21 form an H-shaped profile. The supporting beam 23 connects the middle beam 22 and the lamp post 40 to enhance the rigidity of the bracket 20.

The lamp body 30 is pivotably connected with free ends of the main beams 21 via the shaft 80 extending therethrough. The lamp body 30 is divided into a front portion remote from the cover 50 and a rear portion adjacent to the cover 50 by the shaft 80. In this embodiment, the front portion functions as a luminous portion 31, and the rear portion functions as a counterweight portion 32. The luminous portion 31 includes a light source such as an LED light source therein. The luminous portion 31 has a top surface 311 and a bottom surface 312. The bottom surface 312 is used as a light emitting surface. The counterweight portion 32 is located near the bracket 20, and the luminous portion 31 is remote from the bracket 20. A bottom end of the cover 50 is located above the top surface 311 of the luminous portion 31. The luminous portion 31 is longer than the counterweight portion 32 so that the luminous portion 31 has larger area for emitting light. The counterweight portion 32 is heavier than the luminous portion 31 to drive the top surface 311 of the luminous portion 31 to upwardly and tightly abut against shock absorbers 54 at the bottom of the cover 50. Thus, the bottom surface 312 of the luminous portion 31 is held in a substantially horizontal position thereby to facilitate lighting the ground. The first heating member 60 has a plate-like shape and is mounted on the top surface 311 of the luminous portion 31 to cover most of the top surface 311.

The cover 50 is mounted on the main beams 21 of the bracket 20 and adjacent to the lamp body 30. The cover 50 has a convex configuration. Two lateral edges of the cover 50 are soldered on and adjacent to free end portions of the main beams 21, respectively. A middle portion of the cover 50 is convex upwardly and hovers on the free end portions of the main beams 21 and the rear portion of the lamp body 30. The cover 50 extends along the main beams 21 and substantially parallel to the main beams 21, whereby the cover 50 is slantways relative to a horizontal plane (i.e. the ground plane). The cover 50 defines a plurality of grooves 51 at a top surface thereof. The grooves 51 extend slantways from top to bottom and each of the grooves 51 has a wider top end and a narrow bottom end. Each of the second heating members 65 has an elongated, plate-like shape. The second heating members 65 are fixed at a bottom surface of the cover 50 and extend slantways, following the slantwise extending direction of the cover 50. The pressure switch 90 is sandwiched between the cover 50 and the counterweight portion 32 (seen in FIG. 4). A top end of the pressure switch 90 is fixed to a central portion of the bottom surface of the cover 50, and a bottom end 91 of the pressure switch 90 contacts a top surface 325 of the counterweight portion 32. The bottom end 91 of the pressure switch 90 can sense an upwardly pressure from the counterweight portion 32. The two shock absorbers 54 are mounted at two sides of the bottom end of the cover 50, respectively. The two shock absorbers 54 can be made of rubber.

In a sunny day, a weight of the counterweight portion 32 holds the lamp body 30 in a substantially horizontal position and makes the top surface 311 of the luminous portion 31 upwardly to abut the shock absorbers 54 at the bottom of the cover 50. In this position, the bottom end 91 of the pressure switch 90 slightly collides the top surface 325 of the counterweight portion 32. A pressure detected by the pressure switch 90 is less than a set value, whereby the pressure switch 90 is off and the first heating member 60 and the second heating member 65 do not connect with a power supply 69 and do not work.

In a snow/snowstorm day, snow 100 falls and accumulates on the cover 50 and the top surface 311 of the luminous portion 31 of the lamp body 10. The snow 100 accumulated on the top surface 311 of the luminous portion 31 provides a weight on the luminous portion 31. The weight of the snow 100 causes the luminous portion 31 to have a trend to rotate around the shaft 80 clockwise as viewed from FIG. 4; thus, the counterweight portion 32 tends to rotate around the shaft 80 clockwise to provide an upward pressure to the pressure switch 90. When the snow 100 gradually accumulates more and more on the luminous portion 31 and the weight of the snow 100 reaches a critical value, the pressure detected by the pressure switch 90 is larger than the set value, whereby the pressure switch 90 is on and the first heating member 60 and the second heating members 65 connect with the power supply 69 and melt the snow 100 on the luminous portion 31 and the cover 50. When the snow 100 is melted into water, flows away from the top surface 311 and the cover 50 and falls onto the ground by the weight thereof, the snow 100 on the cover 50 and the lamp body 30 is mostly removed therefrom. After the snow 100 is removed and the weight of the snow 100 is reduced to be less than the critical value, the pressure detected by the pressure switch 90 is less than the set value again. The pressure switch 90 becomes off again and the first heating member 60 and the second heating members 65 stop working. When the snow 100 on the top surface 311 accumulates to the predetermined amount again, the first and second heating members 60, 65 work again to melt the snow 100 accumulated on the top surface 311 and the cover 50 to remove the snow 100.

Figure 5:
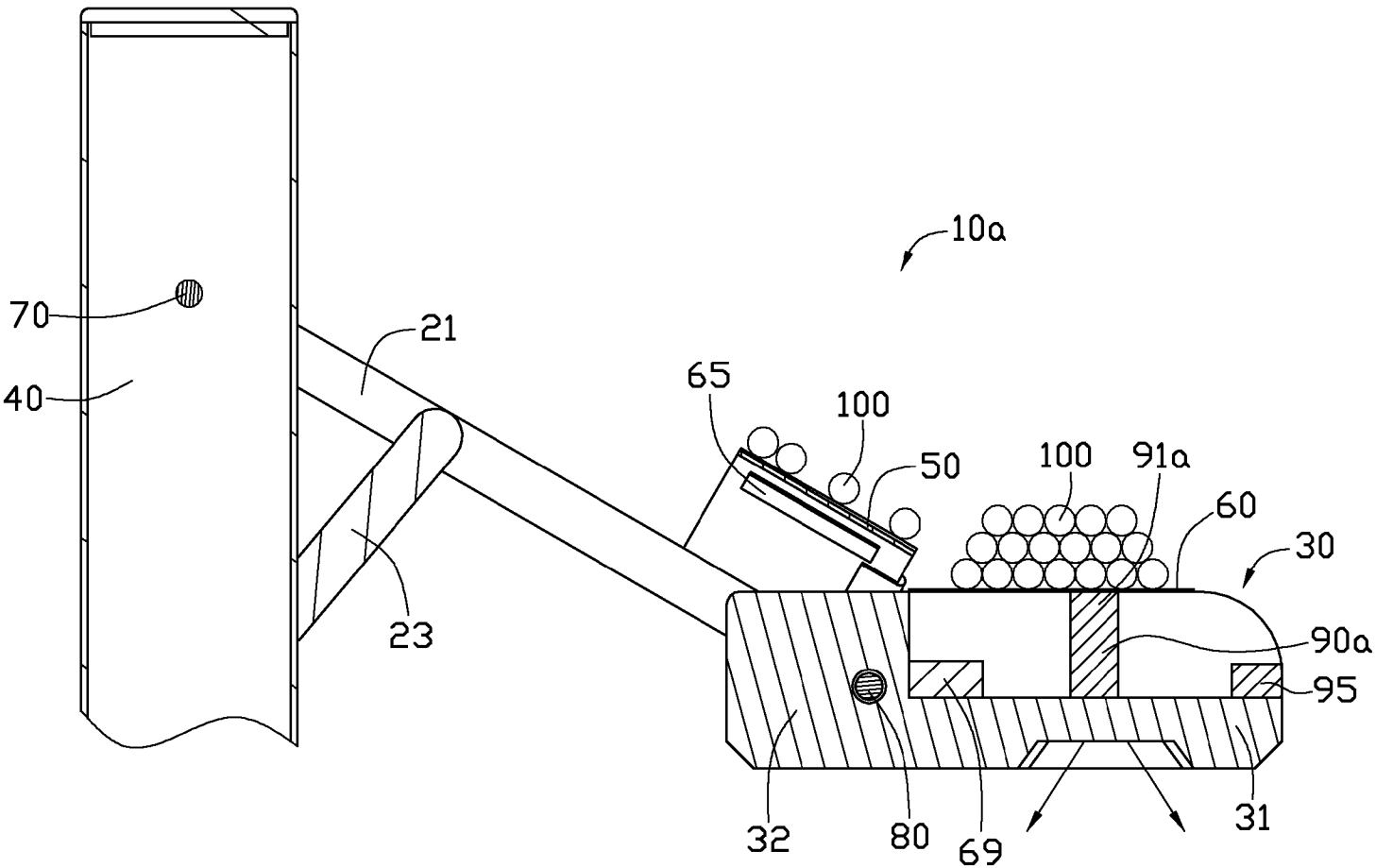
FIG. 5 is a cross-sectional view of a lamp in accordance with a second embodiment of the present disclosure, with snow/ice accumulated on a top of a lamp body of the lamp.

Referring to FIG. 5, a lamp 10*a* in accordance with a second embodiment of the disclosure is illustrated. Different from the pressure switch 90 of the lamp 10 of the first embodiment, a pressure switch 90*a* of the lamp 10*a* is located in the lamp body 30. The pressure switch 90*a* has an upper end 91*a* which supports an inner wall of the top of the luminous portion 31 and can sense a pressure from the top of the luminous portion 31. In this embodiment, the lamp body 30 is firmly fixed on the bracket 20 by the shaft 80. When the snow 100 on the top of the luminous portion 31 accumulates to a predetermined amount, the first heating member 60 and the second heating members 65 are connected with the power supply 69 to melt the snow 100 accumulated on the top of the luminous portion 31 and the cover 50, thereby to avoid a damage to the lamp body 30.

Alternatively, the pressure switch 90*a* can be other sensor switch module, such as infrared sensor, temperature sensor, and so on. When the sensor switch module is an infrared sensor, the infrared sensor can be used to detect a height of the snow 100 on the top of the luminous portion 31 of the lamp body 30 to switch on or switch off the first and second heating members 60, 65. The sensor switch module also can further comprise a temperature sensor 95 (seen in FIG. 5); only when the temperature sensor 95 detects a temperature lower than a set value (such as zero degree) and at the same time the pressure switch 90*a* detects the weight of the snow 100 on the lamp body 30 and the cover 50 beyond the set value, the first heating member 60 and the second heating members 65 start to work to melt the snow 100.

It is to be understood, however, that even though numerous characteristics and advantages of various embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lamp, comprising:

a luminous device comprising a lamp body;

a heating device mounted at a top of the lamp body;

a sensor switch module controlling on and off of the heating device; and a bracket comprising a shaft;

wherein when the sensor switch module detects that an amount of snow/ice accumulated on the lamp body is beyond a set value, the sensor switch module controls the heating device to be switched on to melt the snow/ice;

wherein the sensor switch module comprises a pressure switch and when a weight of the snow/ice accumulated on the lamp body is beyond a set weight, the sensor switch module controls the heating device to be switched on to melt the snow/ice and when the weight of the snow/ice accumulated on the lamp body decreases to be less than the set weight, the sensor switch module controls the heating device to be switch off to stop melting the snow/ice; and wherein the lamp body is pivotably engaged with the shaft of the bracket and comprises a luminous portion at a side of the shaft and a counterweight portion at an opposite of the shaft, the pressure switch colliding on a top of the counterweight portion and the snow/ice being accumulated on a top of the luminous portion.

2. The lamp as claimed in claim 1, further comprising a cover to cover the counterweight portion, the pressure switch being fixed under the cover.

3. The lamp as claimed in claim 2, wherein the cover defines a plurality of grooves at a top surface thereof, the grooves each having a wider top end and a narrow bottom end.

4. The lamp as claimed in claim 2, wherein the heating device comprises a first heating member mounted on the top of the luminous portion and a second heating member under the cover.

5. The lamp as claimed in claim 4, wherein the first heating member has a plate-like configuration and covers most areas of the top of the luminous portion.

6. A lamp, comprising:

a bracket comprising a shaft and a cover;

a lamp body engaged with the shaft of the bracket, the lamp body comprising a first portion at a side of the shaft and a and a second portion at an opposite of the shaft;

a heating device mounted at a top of the first portion of the lamp body; and a pressure switch engaging the cover and colliding on a top of the second portion;

wherein when a weight of the snow/ice accumulated on the first portion of the lamp body is beyond a set value, the pressure switch controls the heating device to be switched on to melt the snow/ice; when the weight of the snow/ice accumulated on the lamp body decreases to be less than the set value, the pressure switch controls the heating device to be switched off to stop melting the snow/ice.

7. The lamp as claimed in claim 6, wherein the cover defines a plurality of grooves at a top surface thereof, the grooves each having a wider top end and a narrow bottom end.

8. The lamp as claimed in claim 6, wherein the heating device comprises a first heating member mounted on the top of the first portion and a second heating member under the cover.

9. The lamp as claimed in claim 8, wherein the first heating member has a plate-shaped configuration and covers most areas of the top of the luminous portion.

* * * * *